US009004154B2

(12) United States Patent
Hagshenas et al.

(10) Patent No.: US 9,004,154 B2
(45) Date of Patent: Apr. 14, 2015

(54) COMBINATION FUEL-OIL AND AIR-OIL HEAT EXCHANGER

(75) Inventors: Behzad Hagshenas, San Diego, CA (US); Stacey H. Light, San Diego, CA (US)

(73) Assignee: Pratt & Whitney, East Hartford, CT (US)

( * ) Notice: Subject to any disclaimer, the term of this patent is extended or adjusted under 35 U.S.C. 154(b) by 1083 days.

(21) Appl. No.: 12/872,845

(22) Filed: Aug. 31, 2010

(65) Prior Publication Data

US 2012/0048530 A1 Mar. 1, 2012

(51) Int. Cl.

| | |
|---|---|
| ***F28D 7/00*** | (2006.01) |
| ***F01M 5/00*** | (2006.01) |
| ***F28F 27/02*** | (2006.01) |

(52) U.S. Cl.

CPC ..... *F28D 7/0066* (2013.01); *F01M 5/00* (2013.01); *F01M 5/007* (2013.01); *F28F 27/02* (2013.01)

(58) Field of Classification Search

CPC ..... F28D 7/0066
USPC ..... 165/279, 280, 281, 285, 299, 100, 101, 165/103, 104.13, 104.14, 283, 29, 7, 297, 165/140; 60/39.08
See application file for complete search history.

(56) References Cited

U.S. PATENT DOCUMENTS

| | | | | |
|---|---|---|---|---|
| 4,020,632 | A * | 5/1977 | Coffinberry et al. | 60/773 |
| 4,696,156 | A * | 9/1987 | Burr et al. | 60/39.08 |
| 4,705,100 | A | 11/1987 | Black et al. | |
| 4,741,152 | A * | 5/1988 | Burr et al. | 60/772 |
| 5,615,547 | A * | 4/1997 | Beutin et al. | 60/39.08 |
| 5,666,807 | A * | 9/1997 | Bianchetta | 60/329 |
| 2010/0107603 | A1 * | 5/2010 | Smith | 60/267 |
| 2010/0212857 | A1 | 8/2010 | Bulin et al. | |

* cited by examiner

*Primary Examiner* — Mohammad M Ali
*Assistant Examiner* — Raheena Rehman
(74) *Attorney, Agent, or Firm* — Stephen G. Mican

(57) ABSTRACT

A combination fuel-oil and air-oil heat exchanger comprising: a first heat exchanger section that has an oil circulation path and a fuel circulation path thermally coupled to the oil circulation path; a second heat exchanger section that has an oil circulation path and an air circulation path thermally coupled to the oil circulation path; an oil coupling path that couples an oil circulation path outlet of the first heat exchanger section to an oil circulation path inlet of the second heat exchanger section to establish a combined oil circulation path; an oil path by-pass valve that selectively diverts oil from the combined oil circulation path to an outlet of the oil path by-pass valve; and a fuel path by-pass valve that selectively diverts fuel from the fuel circulation path of the first heat exchanger section to an outlet of the fuel path by-pass valve.

21 Claims, 4 Drawing Sheets

COMBINATION FUEL-OIL AND AIR-OIL HEAT EXCHANGER

Figure 1:
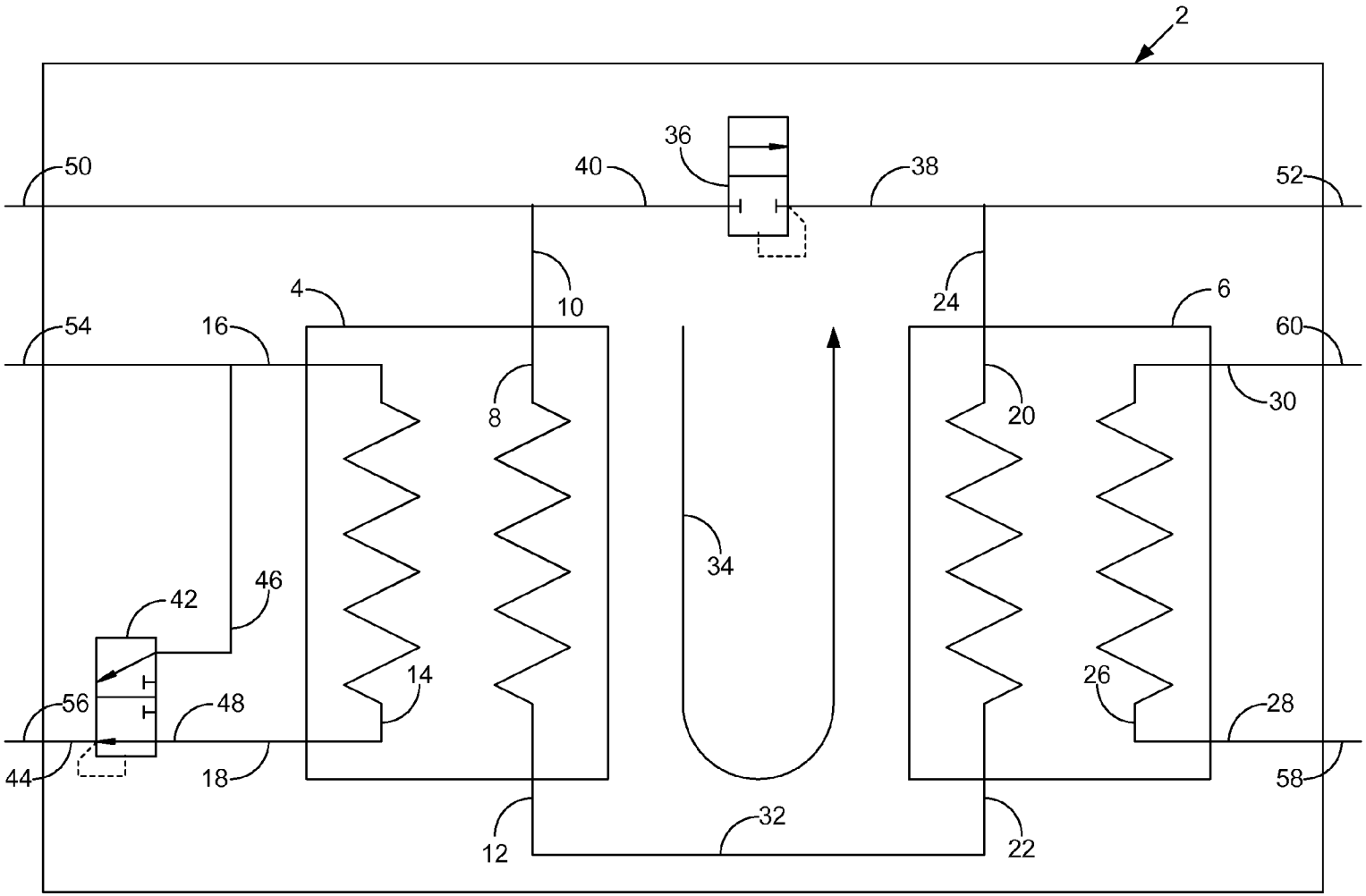
Figure 2:
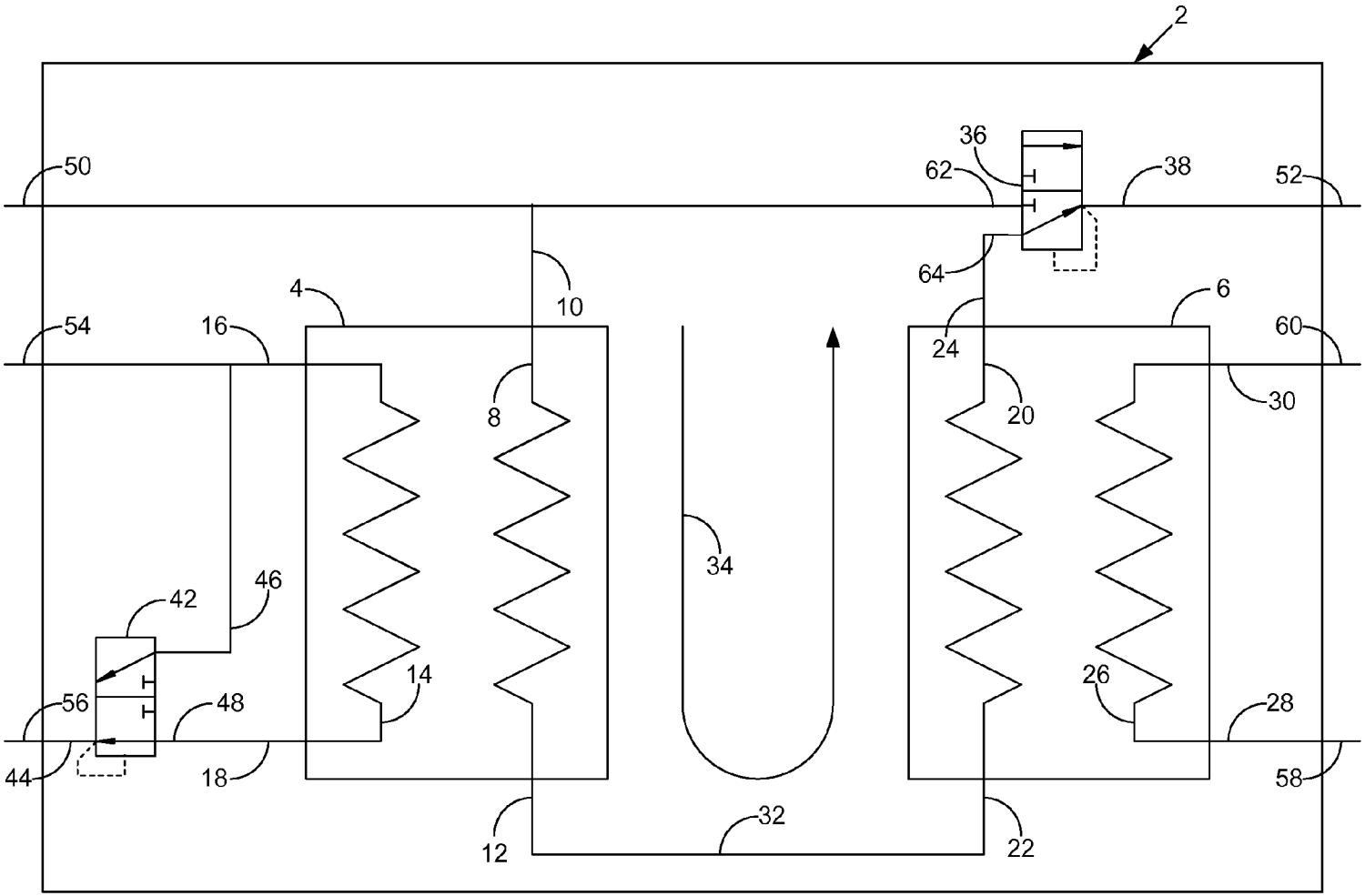
Figure 3:
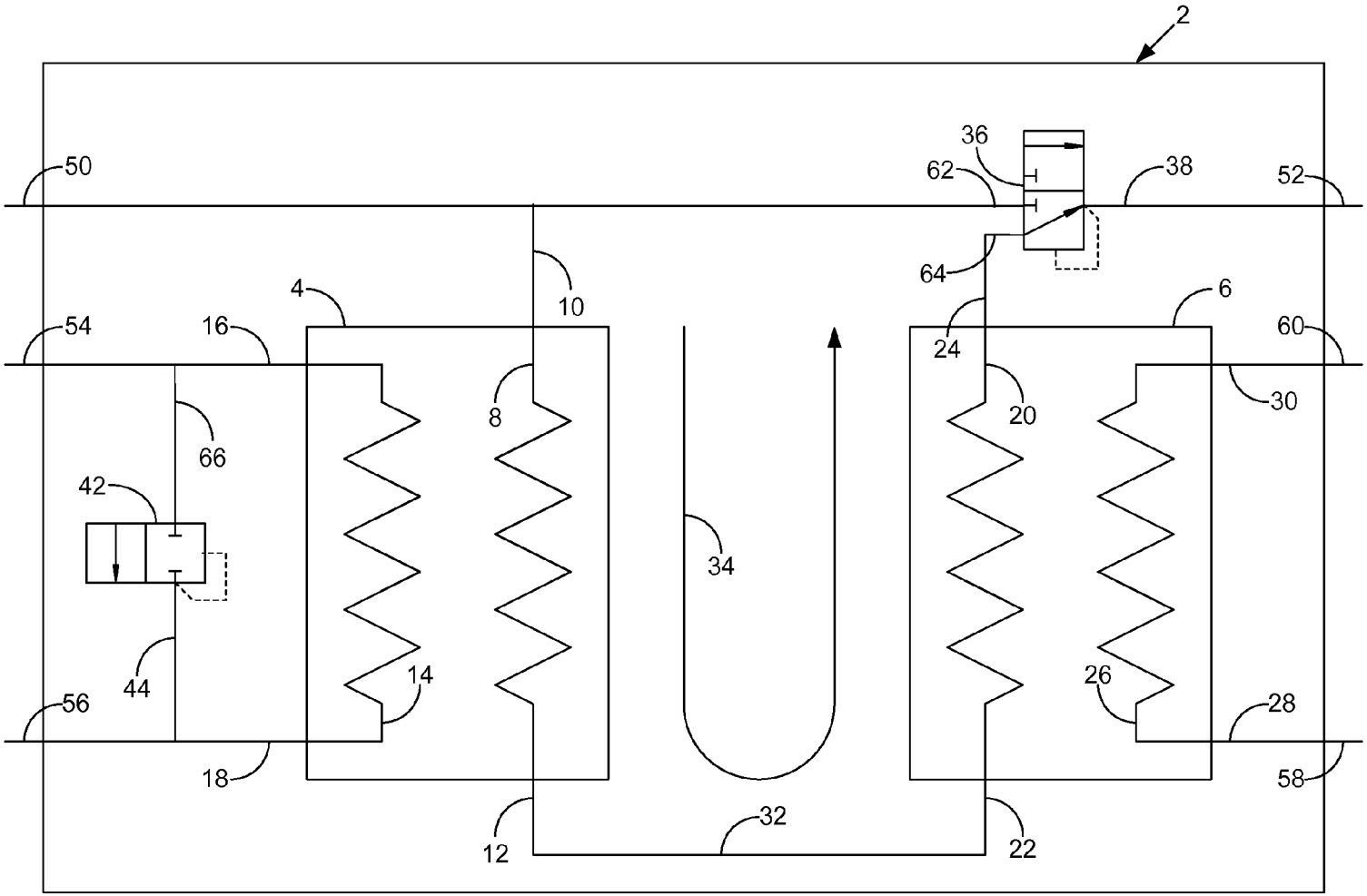
Figure 4:
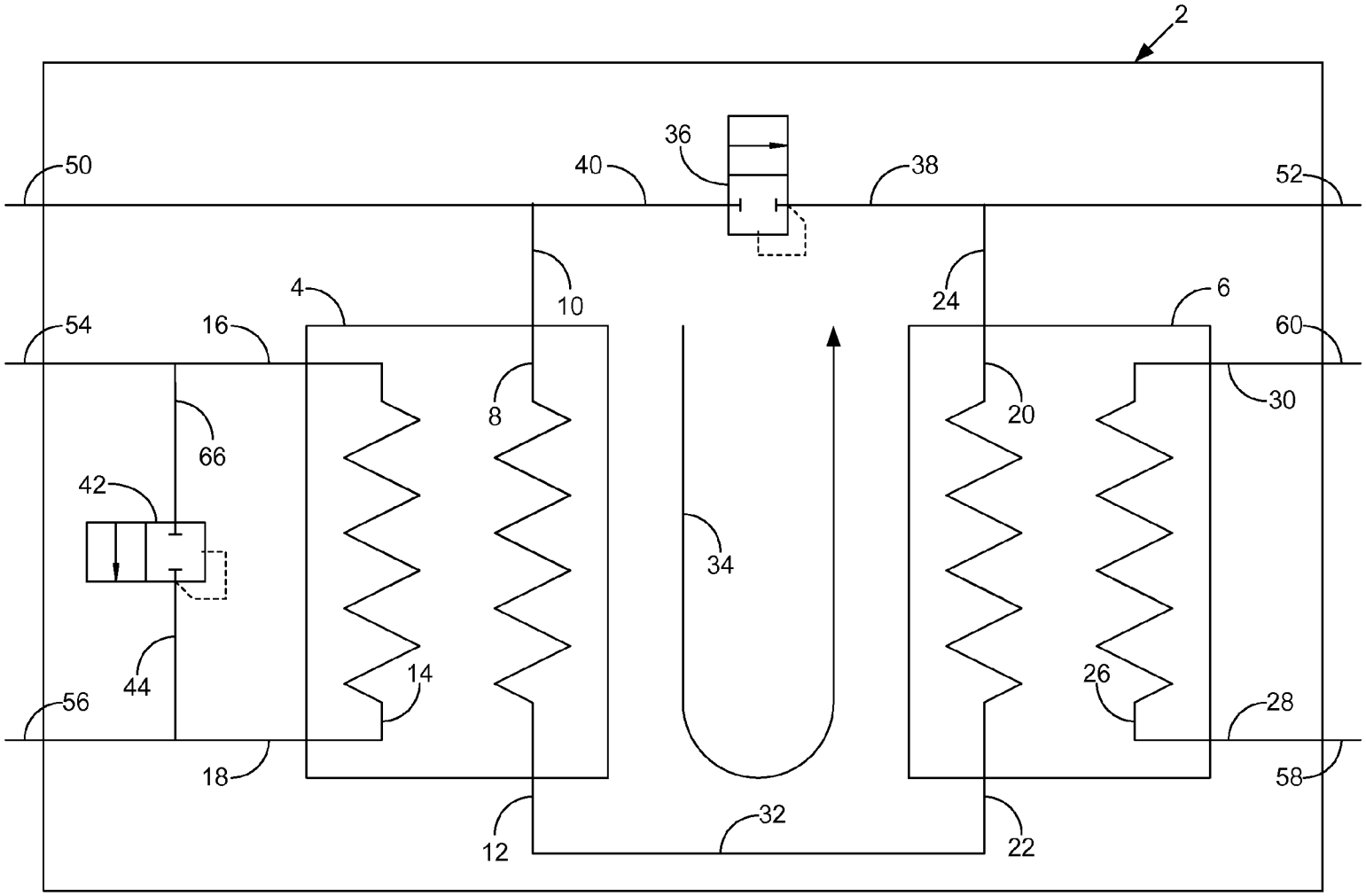

FIG. 1 is a combination fuel-oil and air-oil heat exchanger according to a first possible embodiment of the invention. FIG. 2 is a combination fuel-oil and air-oil heat exchanger according to a second possible embodiment of the invention. FIG. 3 is a combination fuel oil and air-oil heat exchanger according to a third possible embodiment of the invention. FIG. 4 is a combination fuel-oil and air-oil heat exchanger according to a fourth possible embodiment of the invention.

FIG. 1 is a combination fuel-oil and air-oil heat exchanger 2 according to a first possible embodiment of the invention. The heat exchanger 2 has a first heat exchanger section 4 and a second heat exchanger section 6. The first heat exchanger section 4 has an oil circulation path 8 with an inlet 10 and an outlet 12 and a fuel circulation path 14 with an inlet 16 and an outlet 18. The oil circulation path 8 thermally couples to the fuel circulation path 14. Any known heat exchanger arrangement may establish such thermal coupling, such as shell and tube, plate or plate fin arrangements, and the oil circulation path 8 may have parallel flow, counter flow or cross flow relative to the fuel circulation path 14 therein. The second heat exchanger section 6 has an oil circulation path 20 with an inlet 22 and an outlet 24 and an air circulation path 26 with an inlet 28 and an outlet 30. The oil circulation path 20 thermally couples to the air circulation path 26. Any known heat exchanger arrangement may establish such thermal coupling, such as shell and tube, plate or plate fin arrangements and the oil circulation path 20 may have parallel flow, counter flow or cross flow relative to the air circulation path 26 therein.

An oil coupling path 32 couples the oil circulation path outlet 12 of the first heat exchanger section 4 to the oil circulation path inlet 22 of the second heat exchanger section 6 to establish a combined oil circulation path 34 through the first heat exchanger section and the second heat exchanger section. An oil by-pass valve 36 selectively diverts oil from flowing through the combined oil circulation path 34 to an outlet 38 of the oil by-pass valve 36. The oil by-pass valve 36 may comprise a two-way valve, such as shown in FIG. 1, or a three-way valve. In the form of a two-way valve, the oil by-pass valve 36 has its outlet 38 coupled to the outlet 24 of the oil circulation path 20 and an inlet 40 that couples to the inlet 10 of the oil circulation path 8. The oil by-pass valve 36 is normally closed. The oil by-pass valve 36 may be thermostatically controlled and responsive to temperature of oil passing through the oil circulation path outlet 24 of the oil circulation path 20, wherein it opens when the temperature of oil passing through the outlet 24 of the oil circulation path 20 is less than a predetermined value. Alternatively, the oil by-pass valve 36 may be pressure controlled and responsive to pressure drop of oil passing through the oil circulation path outlet 24 of the oil circulation path 20, wherein it opens when the pressure drop of oil passing through the outlet 24 of the oil circulation path 20 exceeds a predetermined value. Although FIG. 1 shows the oil by-pass valve 36 as a self-contained valve of the passive type with an internal pilot, the oil by-pass valve 36 may alternatively comprise a valve of the active type with an external sensor and controller.

A fuel by-pass valve 42 selectively diverts fuel from the fuel circulation path 14 to an outlet 44 of the fuel by-pass valve 42. The fuel by-pass valve 42 may comprise a three-way valve, such as shown in FIG. 1, or a two-way valve. In the form of a three-way valve, the fuel by-pass valve 42 has a first inlet 46 that couples to the inlet 16 of the fuel circulation path 14 and a second inlet 48 that couples to the outlet 18 of the fuel circulation path 14. The fuel by-pass valve 42 normally selects the second inlet 48. The fuel by-pass valve 42 may be thermostatically controlled and responsive to temperature of fuel passing through the outlet 18 of the fuel circulation path 14, wherein it selects the first inlet 46 when the temperature of fuel passing through the outlet 44 of the fuel by-pass valve 42 is greater than a predetermined value. Alternatively, the fuel by-pass valve 42 may be pressure-controlled and responsive to pressure drop of fuel passing through the fuel circulation path 14, wherein it selects the first inlet 46 when the pressure drop of fuel passing through the outlet 44 of the fuel by-pass valve 42 is less than a predetermined value. Although FIG. 1 shows the fuel by-pass valve 42 as a self-contained valve of the passive type with an internal pilot, the fuel by-pass valve 42 may alternatively comprise a valve of the active type with an external sensor and controller.

The heat exchanger 2 has an oil inlet 50 that couples to the inlet 10 of the oil circulation path 8 and an oil outlet 52 that couples to the outlet 38 of the oil by-pass valve 36. The heat exchanger 2 has a fuel inlet 54 that couples to the inlet 16 of the fuel circulation path 14 and a fuel outlet 56 that couples to the outlet 44 of the fuel by-pass valve 42. The heat exchanger 2 has an air inlet 58 that couples to the inlet 28 of the air circulation path 26 and an air outlet 60 that couples to the outlet 30 of the air circulation path 26.

FIG. 2 is the combination fuel-oil and air-oil heat exchanger 2 according to a second possible embodiment of the invention. It is much the same as the heat exchanger 2 of FIG. 1, except that the oil by-pass valve 36 comprises a three-way valve. The oil by-pass valve 36 has a first inlet 62 that couples to the inlet 10 of the oil circulation path 8 and a second inlet 64 that couples to the outlet 24 of the oil circulation path 20. The oil by-pass valve 36 normally selects the second inlet 64. The oil by-pass valve 36 may be thermostatically-controlled and responsive to temperature of oil passing through the outlet 24 of the oil circulation path 20, wherein it selects the first inlet 62 when the temperature of oil passing through the outlet 38 of the by-pass valve 36 is less than a predetermined value. Alternatively, the oil by-pass valve 36 may be pressure-controlled and responsive to pressure drop of oil passing through the oil circulation path 20, wherein it selects the first inlet 62 when the pressure drop of oil passing through the outlet 38 of the by-pass valve 36 is greater than a predetermined value. Although FIG. 2 shows the oil by-pass valve 36 as a self-contained valve of the passive type with an internal pilot, the oil by-pass valve 36 may alternatively comprise a valve of the active type with an external sensor and controller.

FIG. 3 is the combination fuel-oil and air-oil heat exchanger 2 according to a third possible embodiment of the invention. It is much the same as the heat exchanger 2 of FIG. 2, except that the fuel by-pass valve 42 comprises a two-way valve. The fuel by-pass valve 42 has its outlet 44 coupled to the outlet 18 of the fuel circulation path 14 and an inlet 66 that couples to the inlet 16 of the fuel circulation path 14. The fuel by-pass valve 42 is normally closed. The fuel by-pass valve 42 may be thermostatically controlled and responsive to temperature of fuel passing through the fuel circulation path outlet 18 of the oil circulation path 14, wherein it opens when the temperature of fuel passing through the outlet 18 of the fuel circulation path 14 is greater than a predetermined value. Alternatively, the fuel by-pass valve 42 may be pressure controlled and responsive to pressure drop of fuel passing through the fuel circulation path outlet 18 of the oil circulation path 14, wherein it opens when the pressure drop of fuel passing through the outlet 18 of the oil circulation path 14 is less than a predetermined value. Although FIG. 3 shows the fuel by-pass valve 42 as a self-contained valve of the passive type with an internal pilot, the fuel by-pass valve 42 may alternatively comprise a valve of the active type with an external sensor and controller.

FIG. 4 is the combination fuel-oil and air-oil heat exchanger 2 according to a fourth possible embodiment of the invention. It utilises the two-way type of oil by-pass valve 36 as shown in FIG. 1 in combination with the two-way type of fuel by-pass valve 42 as shown in FIG. 3.

One possible use for the combination fuel-oil and air-oil heat exchanger 2 as described in the four embodiments is for heating fuel and cooling oil in aeronautical engines, particularly aeronautical engines of the gas turbine type. In such use, aeronautical fuel has a tendency to accumulate small amounts of water, which water may ice up and clog fuel system components, such as the fuel filter, the fuel pump and fuel injectors when ambient temperatures are low. The heat exchanger 2 heats the fuel with engine oil to raise the temperature of the fuel upstream of these fuel components to prevent such icing. The heat exchanger 2 also uses forced air to cool engine oil flowing through the heat exchanger to a normal range of operating temperatures. The oil by-pass valve 36 selectively diverts oil from the combined oil circulation path 34 of the heat exchanger 2 to the outlet 38 of the oil path by-pass valve 36 when the oil is cold to prevent excessive pressure drop across the heat exchanger 2. It does this by either sensing the temperature or pressure drop of the oil passing through the combination oil circulation path 34. The fuel by-pass valve 42 selectively diverts fuel from the fuel circulation path 14 of the heat exchanger 2 to the outlet 44 of the fuel path by-pass valve when the fuel reaches a predetermined excessive temperature due to heating by the engine oil in the heat exchanger 2.

The described embodiments as set forth herein represents only some illustrative implementations of the invention as set forth in the attached claims. Changes and substitutions of various details and arrangement thereof are within the scope of the claimed invention.

The invention claimed is:

1. A combination fuel-oil and air-oil heat exchanger comprising:

a first heat exchanger section that includes an oil circulation path and a fuel circulation path, the oil circulation path in thermal communication with the fuel circulation path;

a second heat exchanger section that includes an oil circulation path and an air circulation path, the oil circulation path in thermal communication with the air circulation path;

an oil coupling path between an oil circulation path outlet of the first heat exchanger section and an oil circulation path inlet of the second heat exchanger section to establish a combined oil circulation path through the first heat exchanger section and the second heat exchanger section, with an inlet of the combined oil circulation path upstream of the oil circulation path of the first heat exchanger section and an outlet of the combined oil circulation path downstream of the oil circulation path of the second heat exchanger section;

an oil path by-pass valve that selectively couples oil from an oil circulation path inlet of the first heat exchanger section to an oil circulation path outlet of the second heat exchanger section to bypass both the first heat exchanger section and the second heat exchanger section and diverts oil from the inlet of the combined oil circulation path to the outlet of the combined oil circulation path; and a fuel path by-pass valve that selectively diverts fuel from an inlet of the fuel circulation path of the first heat exchanger section to an outlet of the fuel circulation path.

2. The combination heat exchanger of claim 1, wherein the oil path by-pass valve comprises a normally closed two-way valve with an inlet that couples to the oil circulation path inlet of the first heat exchanger section and the outlet couples to the oil circulation path outlet of the second heat exchanger section.

3. The combination heat exchanger of claim 2, wherein the oil path by-pass valve is thermostatically controlled and responsive to temperature of oil passing through the oil circulation path outlet of the second heat exchanger section.

4. The combination heat exchanger of claim 3, wherein the oil path by-pass valve opens when the temperature of oil passing through the oil circulation path outlet of the second heat exchanger section is less than a predetermined value.

5. The combination heat exchanger of claim 2, wherein the oil path by-pass valve is pressure-controlled and responsive to pressure drop of oil passing through the oil circulation path of the second heat exchanger section.

6. The combination heat exchanger of claim 5, wherein the oil path by-pass valve opens when the pressure drop of oil passing through the oil circulation path of the second heat exchanger section is greater than a predetermined value.

7. The combination heat exchanger of claim 1, wherein the oil path by-pass valve comprises a three-way valve with a first inlet that couples to the oil circulation path inlet of the first heat exchanger section, a second inlet that couples to the oil circulation path outlet of the second heat exchanger section and a normal selection of the second inlet.

8. The combination heat exchanger of claim 7, wherein the oil path by-pass valve is thermostatically controlled and responsive to temperature of oil passing through the oil circulation path outlet of the second heat exchanger section.

9. The combination heat exchanger of claim 8, wherein the oil path by-pass valve selects the first inlet when the temperature of oil passing through the oil circulation path outlet of the second heat exchanger section is less than a predetermined value.

10. The combination heat exchanger of claim 7, wherein the oil path by-pass valve is pressure-controlled and responsive to pressure drop of oil passing through the oil circulation path of the second heat exchanger section.

11. The combination heat exchanger of claim 10, wherein the oil path by-pass valve selects the first inlet when the pressure drop of oil passing through the oil circulation path of the second heat exchanger section is greater than a predetermined value.

12. The combination heat exchanger of claim 1, wherein the fuel path by-pass valve comprises a three-way valve with a first inlet that couples to the fuel circulation path inlet of the first heat exchanger section, a second inlet that couples to the fuel circulation path outlet of the first heat exchanger section and a normal selection of the second inlet.

13. The combination heat exchanger of claim 12, wherein the fuel path by-pass valve is thermostatically-controlled and responsive to temperature of fuel passing through the fuel circulation path outlet of the first heat exchanger section.

14. The combination heat exchanger of claim 13, wherein the fuel path by-pass valve selects the first inlet when the temperature of fuel passing through the fuel circulation path outlet of the first heat exchanger section is greater than a predetermined value.

15. The combination heat exchanger of claim 12, wherein the fuel path by-pass valve is pressure-controlled and responsive to pressure drop of fuel passing through the fuel circulation path of the first heat exchanger section.

16. The combination heat exchanger of claim 15, wherein the fuel path by-pass valve selects the first inlet when the pressure drop of fuel passing through the fuel circulation path outlet of the first heat exchanger section is less than a predetermined value.

17. The combination heat exchanger of claim 1, wherein the fuel path by-pass valve comprises a normally closed two-way valve with an inlet that couples to the fuel circulation path inlet of the first heat exchanger section and the outlet couples to the fuel circulation path outlet of the first heat exchanger section.

18. The combination heat exchanger of claim 17, wherein the fuel path by-pass valve is thermostatically-controlled and responsive to temperature of fuel passing through the fuel circulation path outlet of the first heat exchanger section.

19. The combination heat exchanger of claim 18, wherein the fuel path by-pass valve opens when the temperature of fuel passing through the fuel circulation path outlet of the first heat exchanger section is greater than a predetermined value.

20. The combination heat exchanger of claim 17, wherein the fuel path by-pass valve is pressure-controlled and responsive to pressure drop of fuel passing through the fuel circulation path of the first heat exchanger section.

21. The combination heat exchanger of claim 20, wherein the fuel path by-pass valve opens when the pressure drop of fuel passing through the fuel circulation path outlet of the first heat exchanger section is less than a predetermined value.

* * * * *